US009955835B2

(12) United States Patent
Lubbers et al.

(10) Patent No.: US 9,955,835 B2
(45) Date of Patent: May 1, 2018

(54) FLOOR CLEANING DEVICE

(71) Applicant: KONINKLIJKE PHILIPS N.V., Eindhoven (NL)

(72) Inventors: Matthijs Hendrikus Lubbers, Eindhoven (NL); Pieter Kingma, Eindhoven (NL); Mark Van Wijhe, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days. days.

(21) Appl. No.: 15/322,472

(22) PCT Filed: Oct. 19, 2015

(86) PCT No.: PCT/EP2015/074094
§ 371 (c)(1),
(2) Date: Dec. 28, 2016

(87) PCT Pub. No.: WO2016/062647
PCT Pub. Date: Apr. 28, 2016

(65) Prior Publication Data

US 2017/0215668 A1 Aug. 3, 2017

Related U.S. Application Data

(60) Provisional application No. 62/065,946, filed on Oct. 20, 2014, provisional application No. 62/066,493, filed on Oct. 21, 2014.

(30) Foreign Application Priority Data

Feb. 3, 2015 (EP) ..... 15153559

(51) Int. Cl.
*A47L 9/06* (2006.01)
*A47L 9/04* (2006.01)
*A47L 5/30* (2006.01)

(52) U.S. Cl.
CPC ..... *A47L 9/0686* (2013.01); *A47L 5/30* (2013.01); *A47L 9/0477* (2013.01)

(58) Field of Classification Search
CPC ..... A47L 5/30; A47L 9/0477; A47L 9/0613; A47L 9/06; A47L 9/0673; A47L 5/28; A47L 9/248; A47L 9/0018
See application file for complete search history.

(56) References Cited

U.S. PATENT DOCUMENTS 6,966,098 B2 * 11/2005 Sako ..... A47L 5/28 15/231
7,013,528 B2 * 3/2006 Parker ..... A47L 5/28 15/364
8,230,550 B2 7/2012 Krebs
8,387,193 B2 3/2013 Ziegler
8,458,850 B2 6/2013 Kasper
(Continued)

FOREIGN PATENT DOCUMENTS

EP 2250957 A2 11/2010
JP 1014829 A 1/1998

*Primary Examiner* — Dung Van Nguyen

(57) ABSTRACT

A nozzle (10) for a floor cleaning device, suitable for both wet and dry cleaning, the nozzle comprising an airflow inlet (50) at a front end of the nozzle, and a detachable cleaning device (90) that, if mounted on the nozzle (10), lifts a rear end of the nozzle.

5 Claims, 4 Drawing Sheets

(56) References Cited

U.S. PATENT DOCUMENTS

| | | | | |
|---|---|---|---|---|
| 8,567,009 | B2 * | 10/2013 | Krebs | A47L 9/02 15/393 |
| 2004/0045126 | A1 | 3/2004 | Parker | |
| 2004/0134025 | A1 | 7/2004 | Murphy | |
| 2010/0024156 | A1 * | 2/2010 | De Soto-Burt | A47L 5/28 15/347 |
| 2010/0236019 | A1 * | 9/2010 | Behrenswerth | A47L 9/02 15/415.1 |
| 2011/0202175 | A1 | 8/2011 | Romanov | |
| 2016/0255902 | A1 | 9/2016 | Legg | |

* cited by examiner

FLOOR CLEANING DEVICE

This application is the U.S. National Phase application under 35 U.S.C. § 371 of International Application No. PCT/EP2015/074094, filed on Oct. 19, 2015, which claims the benefit of U.S. Provisional Application No. 62/065,946 filed Oct. 20, 2014 and U.S. Provisional Application No. 62/066,493 filed on Oct. 21, 2014 and International Application No. 15153559.8 filed on Feb. 3, 2015. These applications are hereby incorporated by reference herein.

FIELD OF THE INVENTION

The invention relates to a floor cleaning device, and in particular to a nozzle for the floor cleaning device.

BACKGROUND OF THE INVENTION

Hard floor cleaning is traditionally done by first vacuuming the floor, followed by mopping it. Vacuuming removes the coarse dirt, while mopping removes the stains.

These days there are more and more appliances on the market that claim to vacuum and mop in one go. Many of these appliances have a vacuum nozzle for picking up the coarse dirt by airflow and a (wet) cloth for removing the stains. These wet cloths can be pre-wetted, or liquid can be sprayed to wet the floor by user. However, such appliances do have their own share of issues which the user perceives such as maintenance and cleanliness. A quick transition cannot be made from the hard floor mopping to a soft floor vacuuming function.

Several wet mopping devices exist in the market but the classic one is the bucket and mop. The main disadvantage of the bucket and mop principle is that the amount of water transferred to the floor from the mop is difficult to control. This strongly depends on how well the mop is wrung by the user. Some buckets have a mechanical system that helps to wring the mop. Still the amount of water on the floor depends on the force the user puts on the wringer and also depends on the amount of force that is put on the mop by the user during cleaning the floor. This can result in a poor cleaning performance when the mop is too dry but even worse, it can result in damage to the floor when the mop is too wet. The pre-wetted cloths do solve this problem but give rise to another bigger problem. Due to the fact that the pre-wetted cloths can only contain very little amount of water, the surface area that can be cleaned is very limited. This is also the biggest complaint by the user who buys these products. There are several products in the market that try to solve this issue by adding a reservoir and a spray function to the appliance. In this case, the user can spray a certain amount of liquid to the floor when he notices that the cloth is too dry. If this solution is sufficient depends again strongly on the user. Another disadvantage is that it is not a continuous operating system. The trigger for using it is when the performance is already low.

Electric driven floor scrubbers mainly use electric pumps or dosing systems. Besides this solution is rather expensive, these systems are very vulnerable for pollution/clogging, and in common these pumps are not chemical resistant which a big issue is when detergents are being used.

In general a floor in a common household contains hard floor (tiles, laminate, etc.) and soft floors (carpets, floor mats, etc.). Hard floors are cleaned by first vacuuming and subsequently mopping. Soft floor are cleaned by only vacuuming. The currently known appliances that combine a mopping function with a vacuum function are only suited for hard floors.

SUMMARY OF THE INVENTION

It is an object of the invention to provide an improved floor cleaning device. The invention is defined by the independent claims. Advantageous embodiments are defined in the dependent claims.

One embodiment of this invention describes an accessory (mopping element) for a conventional vacuum cleaner nozzle which converts a simple vacuum cleaning device to a hybrid vacuum cleaning and mop device. Further, the device can vacuum clean and mop (dry or wet) at the same time without polluting the vacuum nozzle and associated parts such as wheels, bristles, squeegee etc. with the water in case a wet mopping function is used. Also, the accessory fits below the vacuum cleaner nozzle and lifts the nozzle a little but still ensures that efficient dust pick up and mopping takes place. Also, as the rear end is lifted, the rear wheels are not polluted and also there are no wheel streaks/marks on the floor. Moreover, the squeegee is also lifted though it maintains a very small gap from the floor and this enables good dust pick up along while the squeegee itself is not polluted. This non-pollution of the squeegee is a very important aspect as the user can directly transit from a hard floor room in the house to a room that has soft floors i.e. from hard floor wet cleaning to soft floor dry vacuuming. It will also be appreciated that the accessory can be connected by simple means such that the accessory can be easily clicked in/with the nozzle. Furthermore, in one embodiment, the accessory is connected to the nozzle via a magnet or any other suitable means, and a mopping substrate is attached via a Velcro strap or any suitable means. The accessory can also house an integrated water reservoir and irrigation/dosing means to wet the substrate in case of a wet mopping alone or wet mopping with vacuuming function/mode.

One embodiment of this invention describes a system that continuously wets the mopping element without any interaction of the user needed.

One embodiment of this invention describes a system in which the accessory can be used just by connecting a stick/rod to the accessory and using the stick/rod to push the accessory around. In this mode, the accessory need not be connected to the vacuum cleaner.

One embodiment of this invention describes a hybrid appliance that can mop hard floors, vacuum hard floors, mop and vacuum hard floors in one go, and vacuum soft floors, all with good performance. Especially mop and vacuum in one go is a big advantage for the user. It saves a lot of time and effort with the same result.

To vacuum the dust from the floor sufficient airflow is needed. To create sufficient airflow a high power fan is needed that is connected to the mains. To combine a mopping function with mains connected appliance is rather dangerous or needs a lot of precautions. The water/moisture can damage the appliance or create a hazardous electric short-circuit. Combining a mopping element with a battery operated appliance reduces the risk on hazardous situations due to electric shock significant. The issue to overcome is that battery operated appliance cannot produce sufficient airflow over acceptable time without having huge amount of batteries. One embodiment of this invention describes a battery operated appliance which uses less power but delivers optimum results for good cleaning performance on all floor types.

These and other aspects of the invention will be apparent from and elucidated with reference to the embodiments described hereinafter.

DESCRIPTION OF EMBODIMENTS

Figure 1:
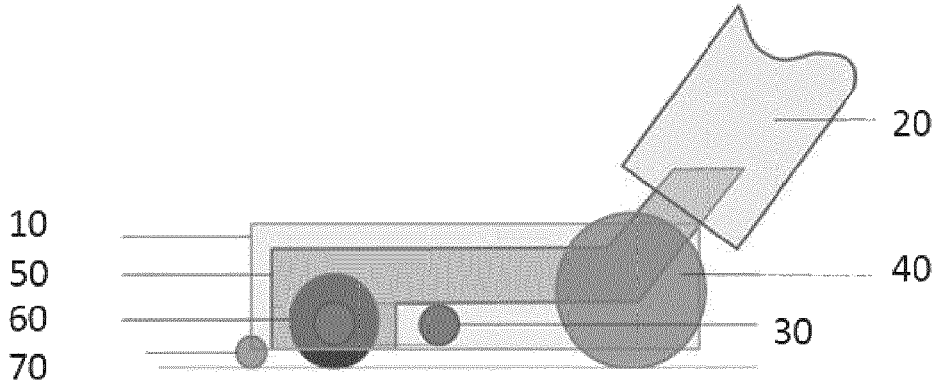
FIG. 1 shows a typical architecture of a battery operated floor cleaning device.

To have a good cleaning performance with low suction power<30 W (mains connected appliances use in general>100 W suction power (current state of art)), agitation of the dust or agitation of the piles of the carpets is necessary. Therefore all common known battery operated appliances are equipped with a rotating brush for agitating the dust/piles. The typical architecture of a battery operated appliance is shown in FIG. 1, which illustrates housing 10, housing stick 20, drive motor rotating brush 30, rear wheel 40, airflow channel 50, rotating brush 60, and front wheel 70. However, it will be appreciated by a person skilled in the art that the battery-operated appliance can be replaced by an appliance which has no batteries and is operated via mains, or by an appliance which is operated via a combination of battery and mains. Further, the appliance may have a non powered brush/passive brush or no brush at all. Furthermore, in case of a powered brush, the brush can be powered using an air turbine or an electric motor either internal or external to the powered brush casing.

Figure 2:
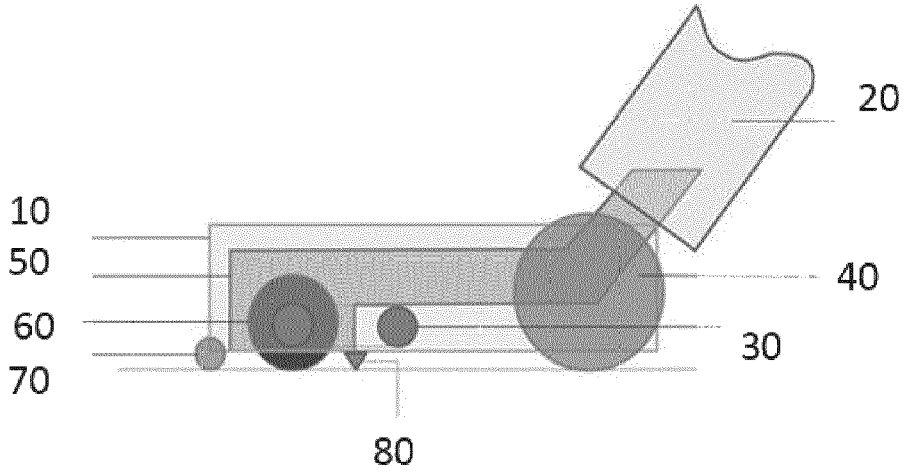
FIG. 2 shows the floor cleaning device of FIG. 1 with a squeegee.
Figure 3:
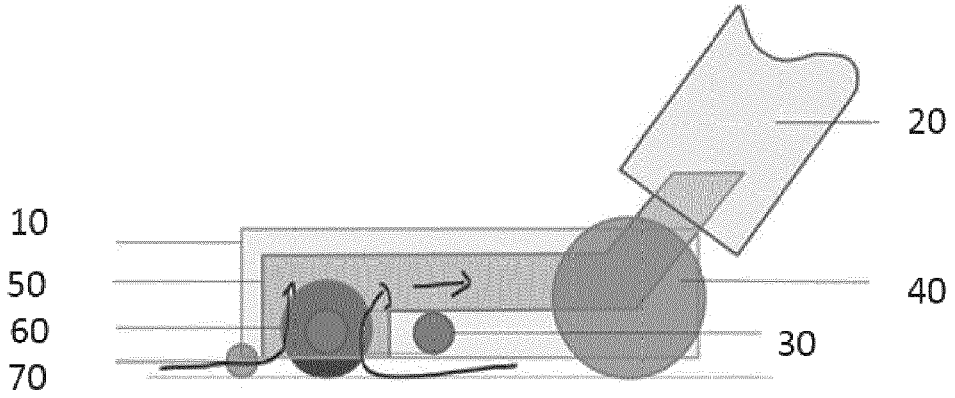
FIG. 3 shows the airflow in the floor cleaning device of FIG. 1.
Figure 4:
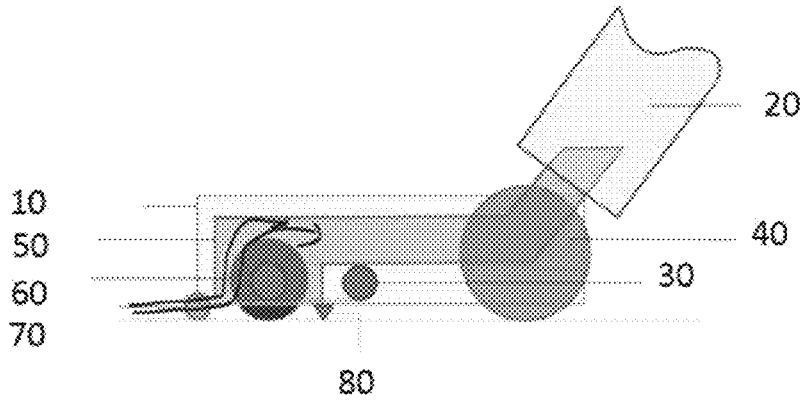
FIG. 4 shows the airflow in the floor cleaning device of FIG. 2.

By in-depth study of user behavior, we know that coarse dirt is approached from the front of the appliance. Especially, when the wheels on the nozzle are clearly visible. Referring to FIGS. 2, 3, and 4, by placing a squeegee 80 behind the rotating brush 60 the airflow is much more efficient to pick up the dirt as the airflow is now concentrated in the front of the nozzle as seen in the Figures.

The appliance with rotating brush and squeegee is able to clean hard and soft floors to an acceptable level.

To make the appliance a hybrid appliance so that hard floors can also be wet cleaned, a mopping element can be added. Because the mopping action is almost simultaneous with the vacuum action, the mop remains clean for a longer period than when performing the vacuum and mopping actions sequentially.

Another additional advantage of using a battery operated appliance and the associated low suction power is that the water which is distributed to the floor by the mopping element is not sucked back up by the suction nozzle. This prevents that the dirt/air separation can be done on the traditional manner without having precautions for water intake. Thus, this eliminates the task of having a expensive water filtration module within the device and makes the device economical.

The three obvious positions to place a mopping element (in front, at the rear or in between wheels and squeegee) will result in an appliance which will get dirty quickly. The brush, squeegee and wheels touch the floor and pick up liquid and wet dirt during usage.

Figure 5:
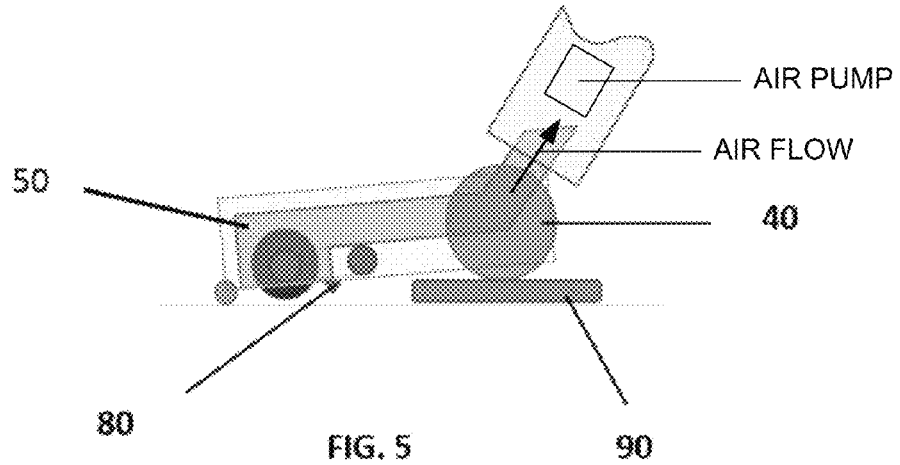
FIG. 5 shows a floor cleaning device provided with a mopping element in accordance with an embodiment of the invention.

Referring now to FIG. 5, to protect squeegee 80 and brush 60 from polluting, in accordance with an aspect of the invention, mopping element 90 is placed underneath the rear wheels 40. The whole system is than tilted a bit, and the squeegee and brush are also lifted from the floor a little. Further, the front end of the nozzle, with or without the wheels, continues to touch the floor as before and is not lifted. Thus, an optimum suction is still maintained and the suction boundaries are formed by the front wheel and the rear squeegee 80 and mopping element 90. Even when for stubborn stains, the appliance is moved several times back and forwards, the brush and squeegee remain clean. It will be appreciated that the squeegee will be lifted in such a manner that it maintains minimal air gap with the floor and thus ensures an optimum suction efficiency.

Figure 6:
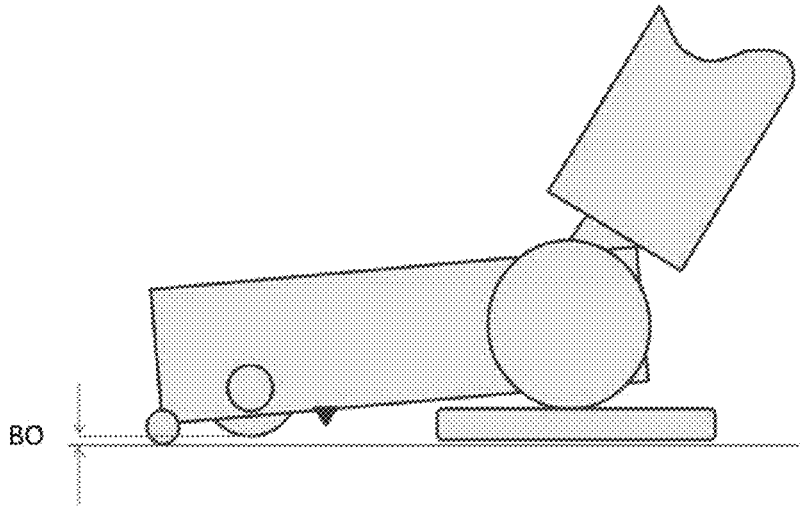
FIG. 6 shows a brush offset as an impact of lifting the rear wheels in the floor cleaning device in accordance with an embodiment of the invention.
Figure 7:
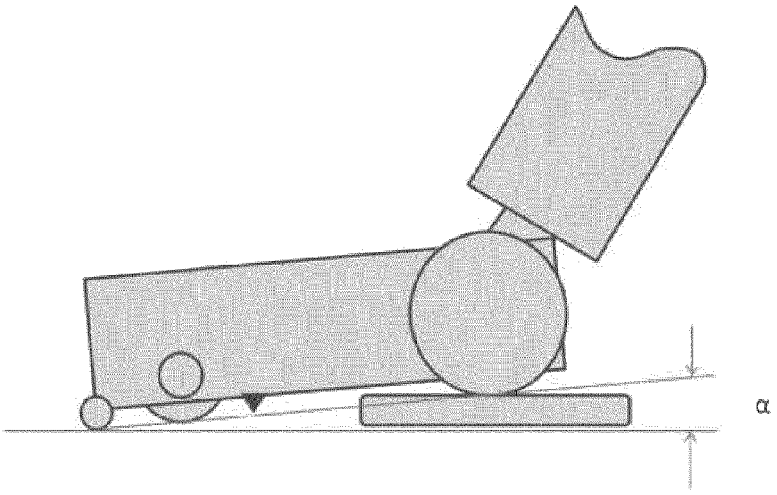
FIG. 7 shows an angular offset as an impact of lifting the rear wheels in the floor cleaning device in accordance with an embodiment of the invention.
Figure 8:
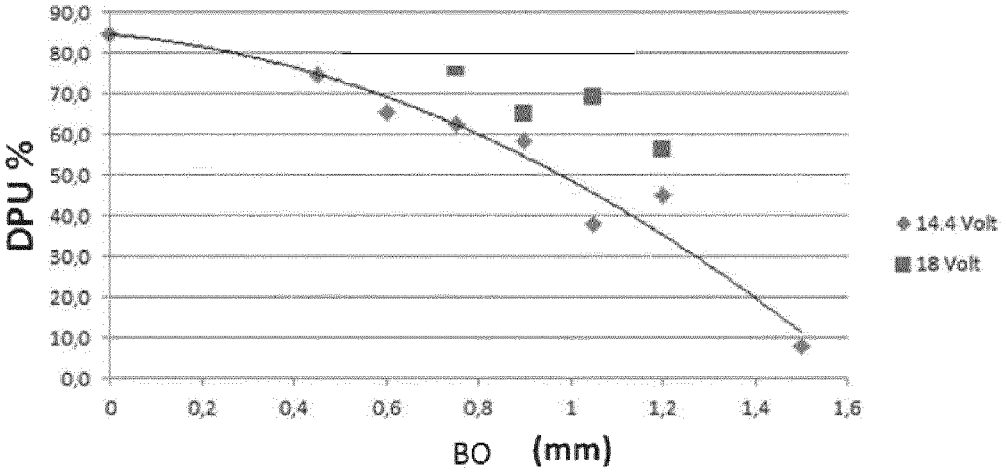
FIG. 8 shows the impact of lifting the rear wheels on the performance on cleaning the crevices.

If the rear wheels are lifted just a little, the performance drop due to lifting the brush and squeegee is very limited. The brush offset BO and lifting of the appliance by angle $\alpha$ can be seen in FIGS. 6 and 7, respectively. The bigger coarse dirt is still touched by the brush and the airflow is still directed to the front. The graph of FIG. 8 shows the impact of lifting on the performance on cleaning crevices (most difficult to clean area of the floors) at two different voltages, i.e. 18 V and 14.4 V respectively: the higher the distance from the floor (horizontal axis), the lower the dirt pick-up percentage DPU (vertical axis). Further, it can be inferred from the graph of FIG. 8 that the performance or percentage DPU drops below 30% when the brush offset BO is more than 1.2 mm. It has been revealed from user studies that a percentage DPU of below 30% is well detected by the user as the user is able to notice a drop in performance/suction and visible cleanliness. Therefore, the brush offset BO will always be kept above 30% DPU levels or between 0-1.2 mm. The two different voltages used to plot the graph correspond to two different upright suction cleaners that were used for testing. It will be appreciated that given a higher voltage rating a higher suction power can be achieved and the brush offset can be even more without undue decrease in DPU and performance i.e. a DPU of 30% and more can be attained with a significant brush offset as compared to the range mentioned above.

The brush offset can be translated into an angular relation that the mopping device makes with the surface to be cleaned, e.g. the floor. The brush offset BO mentioned above can be achieved by angularly rotating in the XY plane the imaginary axis of the front wheels between a range of 0 degrees and 15 degrees both including as shown in FIG. 7. These aforementioned design principles can be adopted to achieve optimum percentage DPU in the device along with good mopping performance.

Figure 12:
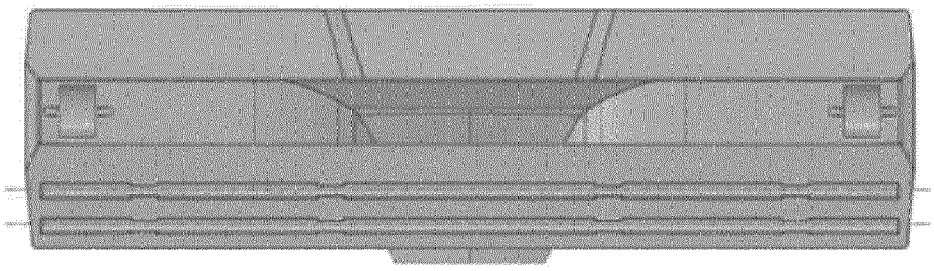
FIG. 12 shows another embodiment of the invention with the front wheels formed at the ends of the suction channel

As shown in FIG. 12, in another embodiment of this invention, the wheels are not present in the front but placed along the suction channel/opening. In this embodiment, when the mopping accessory is placed underneath the rear wheels and the appliance will be lifted then the angle alpha will have very little effect on the suction performance as the suction channel will be closer to the floor then the previous embodiment for the fact that the wheels will be touching the floor and the suction channel is formed between the wheels.

When the mopping element is placed closely to the squeegee it also reduces air leakage to the rear due to the lifting of the squeegee.

By placing the mopping element underneath the wheels, there is also a place created to put small reservoirs on the mopping element beside the wheels.

Figure 9:
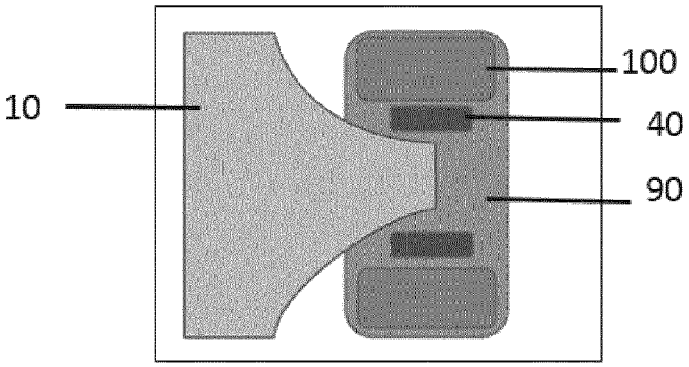
FIG. 9 shows a top view of the floor cleaning device of FIG. 5.

The architecture of a battery operated nozzle is depicted in FIG. 9 (top view), showing housing 10, wheels 40, mopping element 90, and reservoirs 100.

By adding a suitable water transport mechanism (e.g. small holes or wick as described in U.S. application 62/065,950, incorporated herein by reference) between reservoirs 100 and the mopping element, a wet mopping function can be achieved. Further, the cleaning performance overtime is limited by the volume of the reservoir and no longer limited to the amount of water that can be held in the cloth or wipe underneath the mopping element.

It also means that the wetness of the floor does no longer depend on the way it is used by the user. The performance is therefore much more guaranteed and is stable during usage (cloth does not dry out).

The surface area that can be cleaned is only limited by the volume of the reservoir. A wetness of the floor of approximately 2 $gr/m^2$ means that for cleaning an average house of 100 $m^2$ hard floors, a reservoir of 200 ml is sufficient. If the cloth is e.g. 5 cm×30 cm, the height of the reservoir can be less than 1.5 cm.

Because the mopping element contains the reservoirs and the cloth it can be easily be placed and detached from the appliance without making an interface for connecting wet elements. This also means that a hybrid appliance can be built by using the standard architecture of a battery operated vacuum appliance.

A simple interface between the mopping element that contains all the "wet:" parts and the vacuum nozzle can be done on numerous ways. A good and simple way which is very appreciated by users is a connection by magnets.

Figure 10:
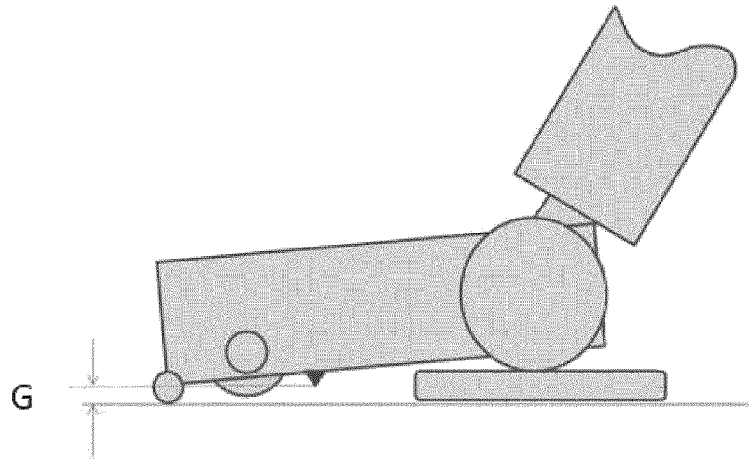
FIGS. 10 and 11 show an embodiment of a floor cleaning device in which the squeegee can shift down when the rear end of the appliance is lifted.
Figure 11:
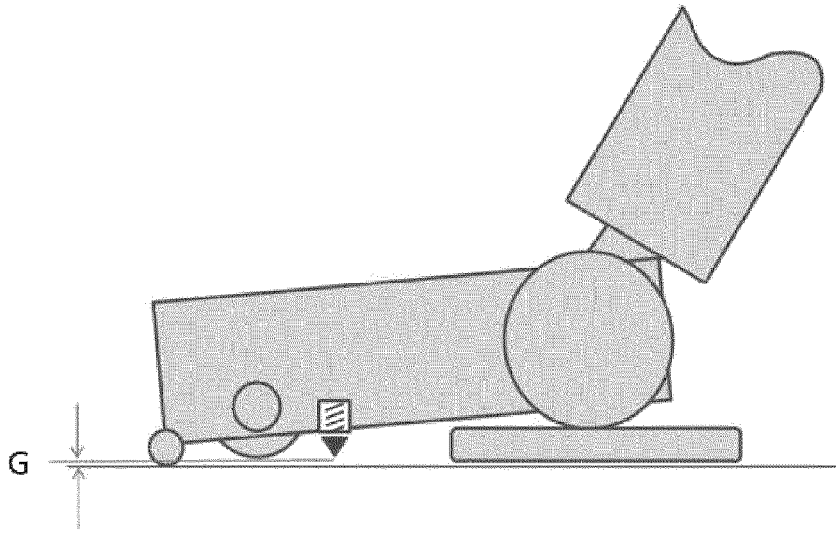

Referring to FIGS. 10 and 11, the reduction in performance of dirt pick up due to lifting the appliance can be reduced by a simple mechanism that the squeegee is fixated in such a manner that it can shift down when the rear end of the appliance is lifted. FIG. 10 shows a normal width of a gap G, while FIG. 11 shows a reduced width of gap G, resulting from a spring that pushes the squeegee downwards. Such a function can be achieved in numerous ways and one example can be by using springs which lowers the squeegee when it is lifted. Also, as mentioned above it will be ensured that the squeegee maintains a minimal air gap when lifted.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The mere fact that certain measures are recited in mutually different dependent claims does not indicate that a combination of these measures cannot be used to advantage.

The invention claimed is:

1. A nozzle for a floor cleaning device, suitable for both wet and dry cleaning, the nozzle comprising:

an airflow inlet at a front end of the nozzle;

a rear wheel at a rear end of the nozzle; and a detachable wet cleaning device configured to be mounted underneath the rear wheel of the nozzle, wherein responsive to being mounted underneath the rear wheel of the nozzle, the detachable wet cleaning device lifts a rear end of the nozzle, wherein the detachable wet cleaning device is further arranged for being provided with a removable mopping substrate, and wherein the detachable wet cleaning device further comprises a liquid container for containing a liquid for wetting the removable mopping substrate.

2. The nozzle as claimed in claim 1, further comprising a squeegee configured to reach substantially close to a surface to be cleaned in response to the detachable wet cleaning device being mounted to the nozzle.

3. The nozzle as claimed in claim 1, further comprising a rotating brush positioned in said airflow inlet, wherein the rotating brush is lifted from a surface to be cleaned in response to the detachable wet cleaning device being mounted to the nozzle, and wherein an offset between said rotating brush and the surface is less than 1.2 mm in response to the detachable wet cleaning device being mounted to the nozzle.

4. A floor cleaning device, comprising a nozzle as claimed in claim 1, and an air pump connectable to the nozzle.

5. The floor cleaning device as claimed in claim 4, wherein the floor cleaning device is battery-operated.

* * * * *